US006783388B2

(12) United States Patent
Matsushita

(10) Patent No.: US 6,783,388 B2
(45) Date of Patent: Aug. 31, 2004

(54) CONNECTOR

(75) Inventor: Yasuo Matsushita, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/152,607

(22) Filed: May 21, 2002

(65) Prior Publication Data

US 2002/0182928 A1 Dec. 5, 2002

(30) Foreign Application Priority Data

May 30, 2001 (JP) ..... 2001-163120

(51) Int. Cl.[7] ..... H01R 3/00
(52) U.S. Cl. ..... 439/489; 439/352
(58) Field of Search ..... 439/489, 544, 439/488, 157, 372, 152, 352, 557, 549

(56) References Cited

U.S. PATENT DOCUMENTS 5,791,935 A * 8/1998 Yamanashi ..... 439/489
5,848,908 A * 12/1998 Katsuma ..... 439/157
5,938,458 A * 8/1999 Krehbiel et al. ..... 439/157
6,012,933 A * 1/2000 Katsuma ..... 439/157
6,213,791 B1 * 4/2001 Kodama ..... 439/157
6,332,789 B1 * 12/2001 Okabe ..... 439/157

FOREIGN PATENT DOCUMENTS

JP 9-245886 9/1997

* cited by examiner

*Primary Examiner*—Gary Paumen
*Assistant Examiner*—Edwin A. Leon
(74) *Attorney, Agent, or Firm*—Gerald E. Hespos; Anthony J. Casella

(57) ABSTRACT

A connector has two housings (10, 30). When the two housings (10, 30) properly connected, movable detectors (25) are at standby positions and do not interfere with an edge of a mount hole (H). Thus, the two housings (10, 30) can be mounted into the mount hole (H). On the other hand, with the two housings (10, 30) partly connected, the movable detectors (25) are displaced to interfering positions and interfere with the edge of the mount hole (H). Thus a partly connected state of the two housings (10, 30) can be detected.

19 Claims, 9 Drawing Sheets

CONNECTOR

BACKGROUND OF THE INVENTION

1. Field of the Invention

The present invention relates to a connector mountable on a panel.

2. Description of the Related Art

A connector assembly that is mountable on a panel is disclosed in Japanese Unexamined Patent Publication No. 9-245886. This assembly includes a male connector that is mounted in a mount hole of a panel and a female connector with a lever. The lever normally remains in a standby position, but can be operated to engage the two connectors and to hold the connectors in a properly connected state.

Part of the female connector and the lever project at the outer side of the panel, and therefore require space. However, the connector may be mounted near a hinge of a door panel of an automotive vehicle, and there may be insufficient space around the body panel when the door is closed. Thus, it is difficult to use this type of a standby-type lever connector in these situations.

Accordingly, consideration has been given to a construction that connects the two connectors beforehand. The already connected connectors then are mounted in the mount hole of the panel, such that the connectors and the lever are at the inner side of the panel. However, the connection is concealed at the inner side of the panel, and it is difficult to detect by eye whether the connectors are connected properly. Accordingly, there has been a demand for a means to detect the connected state before the connector is mounted on the panel.

The present invention was developed in view of the above problem and an object thereof is to detect whether a connector is connected properly.

SUMMARY OF THE INVENTION

The invention is directed to a connector that is fittable into a mount hole of a panel. The connector comprises first and second housings that are connected with each other. The housings comprise a connection detecting means with at least one movable detector that is at a standby position where the movable detector does not interfere with an edge of the mount hole when the housings are connected properly. However, the movable detector is displaceable to an interfering position where the movable detector interferes with the edge of the mount hole when the housings are connected only partly.

The movable detector is at the standby position when the housings are connected properly. Thus, the housings can be mounted into the mount hole. However, the movable detector is at the interfering position when the housings are connected only partially. Hence the movable detector interferes with the edge of the mount hole, and a partly connected state of the housings can be detected.

The first housing may have a lever that is pivotal near the outer surface of the first housing. The lever may comprise a cam groove and the second housing may have a cam follower. The housings are connected by pivoting the lever so that the cam follower and moves along the cam groove. The lever preferably is substantially U-shaped and a transverse space between outer surfaces of the lateral arms is slightly narrower than the mount hole.

The movable detector preferably is formed on the lever. The movable detector normally is at the standby position, but may be displaced resiliently to the interfering position. A pusher may be formed on the outer surface of the housing for pushing the movable detector from inside to resiliently displace the movable detector to the interfering position when the lever is at a partial connection position.

The housings can be connected with a small operation force due to the leverage action of the lever. Thus, a connecting operation can be done by one hand and the connector is suitable for use in a narrow space. Further, the movable detector is at the standby position without being pushed by the pusher when the housings are connected properly. Thus, the two housings can be mounted into the mount hole. The lever is at the partial connection position when the housings are connected partially and the pusher pushes the movable detector to the interfering position. Thus, the movable detector interferes with the edge of the mount hole.

The pusher preferably projects from the outer surface of the first housing and has an arcuate shape extending along a trace of rotation of the movable detector. A substantially arcuate escape groove is formed in the inner surface of the lever for avoiding interference with the pusher.

The pusher projects from the outer surface of the housing, and the escape groove for avoiding interference with the pusher is formed in the inner surface of the lever. Thus, the connector can be made smaller by making a small clearance between the outer surface of the housing and the inner surface of the lever.

The movable detector preferably is formed with at least one slanted pushable portion for contacting the pusher.

The movable detector may be resiliently displaceable from the standby position to the interfering position and biased toward the standby position.

These and other objects, features and advantages of the present invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 1:
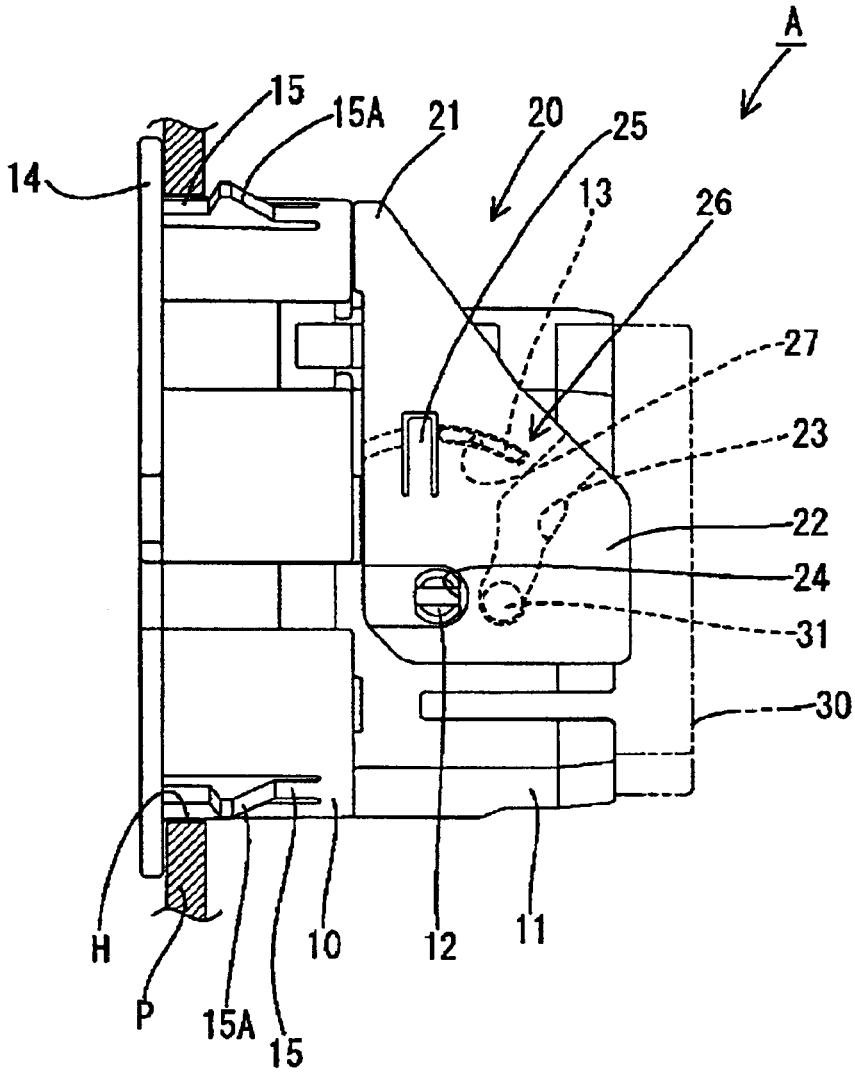
FIG. 1 is a side view partly in section showing a state where male and female housings according to one embodiment are mounted on a panel while being properly connected.
Figure 2:
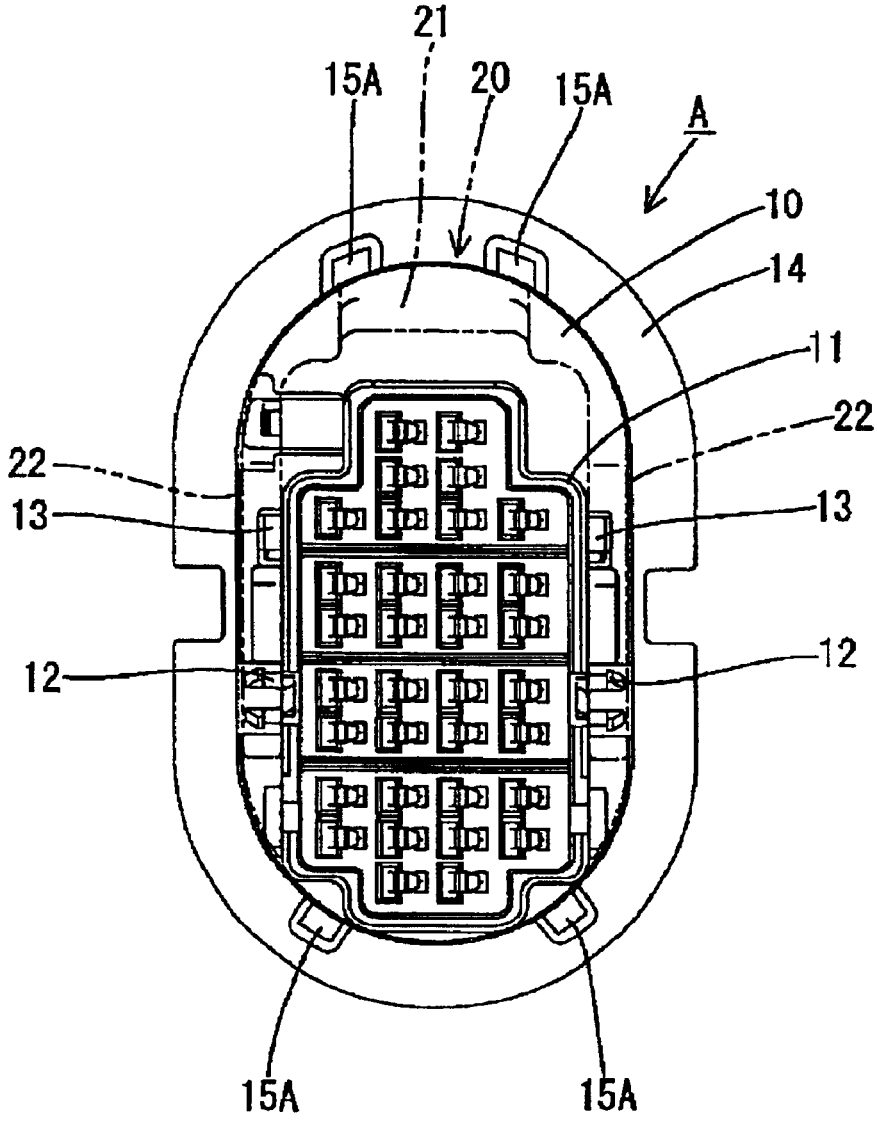
FIG. 2 is a front view showing a properly connected state of the two housings.

A connector A according to the invention has a male housing 10, a lever 20 and a female housing 30. The lever 20 can be operated to connect or assist in the connection of the housings 10, 30. The connector A then is mountable in a mount hole H of a panel P.

The male housing 10 has a generally oblong shape with semicircular upper and lower ends and a forwardly projecting receptacle 11 of the same shape. Male tabs (not shown) are accommodated in the receptacle 11. Two shafts 12 project from the side surfaces of the male housing 10, and pushers 13 in the form of long and narrow arcs have the corresponding shafts 12 as a center. A substantially oblong flange 14 is formed on the outer periphery of the rear end of the male housing 10, and upper and lower resilient locks 15 are formed at positions slightly before the flange 14.

The lever 20 has an operable portion 21 and two plate-shaped arms that 22 project from the opposite ends of the operable portion 21. Cam grooves 23 are formed in the inner surfaces of the arms 22. The arms 22 have bearing holes 24 that engage the shafts 12, so that the arms 22 pivot along the outer side surfaces of the male housing 10. A transverse spacing between the outer side surfaces of the arms 22 is slightly less than the width of an opening of the mount hole H in transverse direction.

Figure 3:
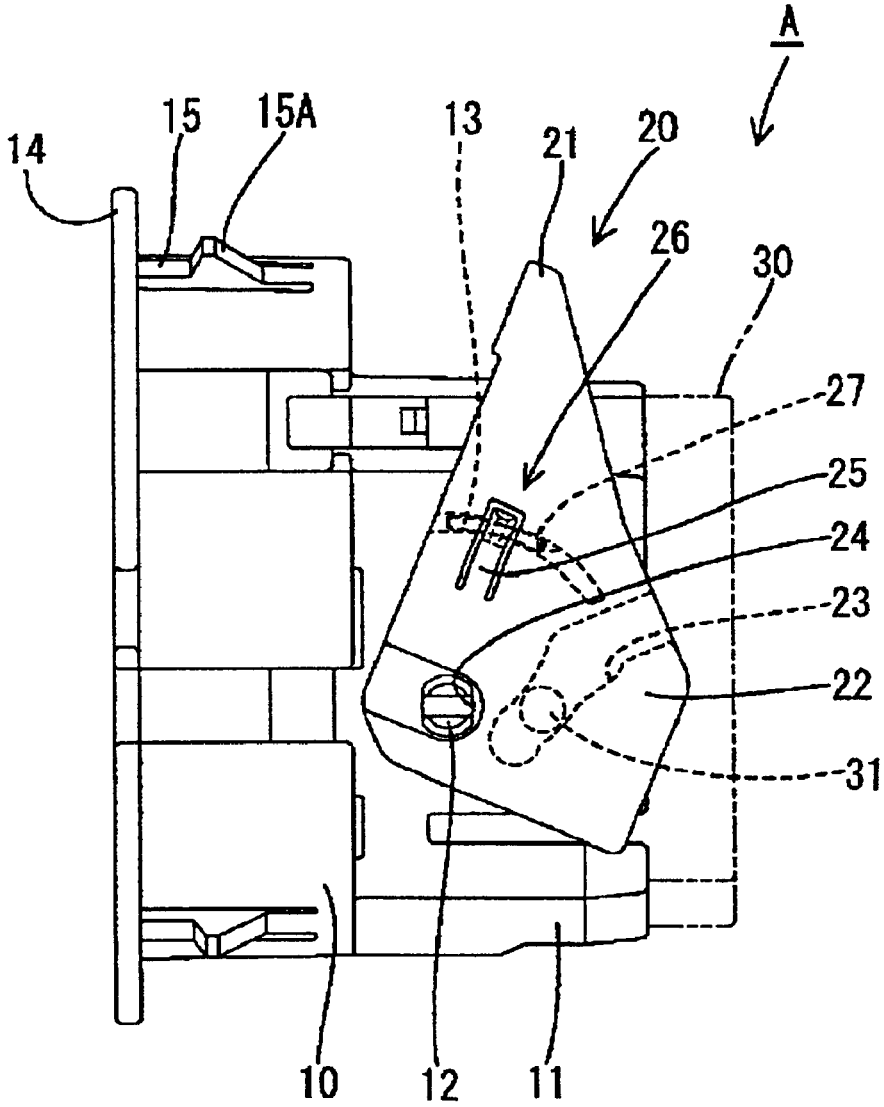
FIG. 3 is a side view showing a partly connected state of the two housings.
Figure 4:
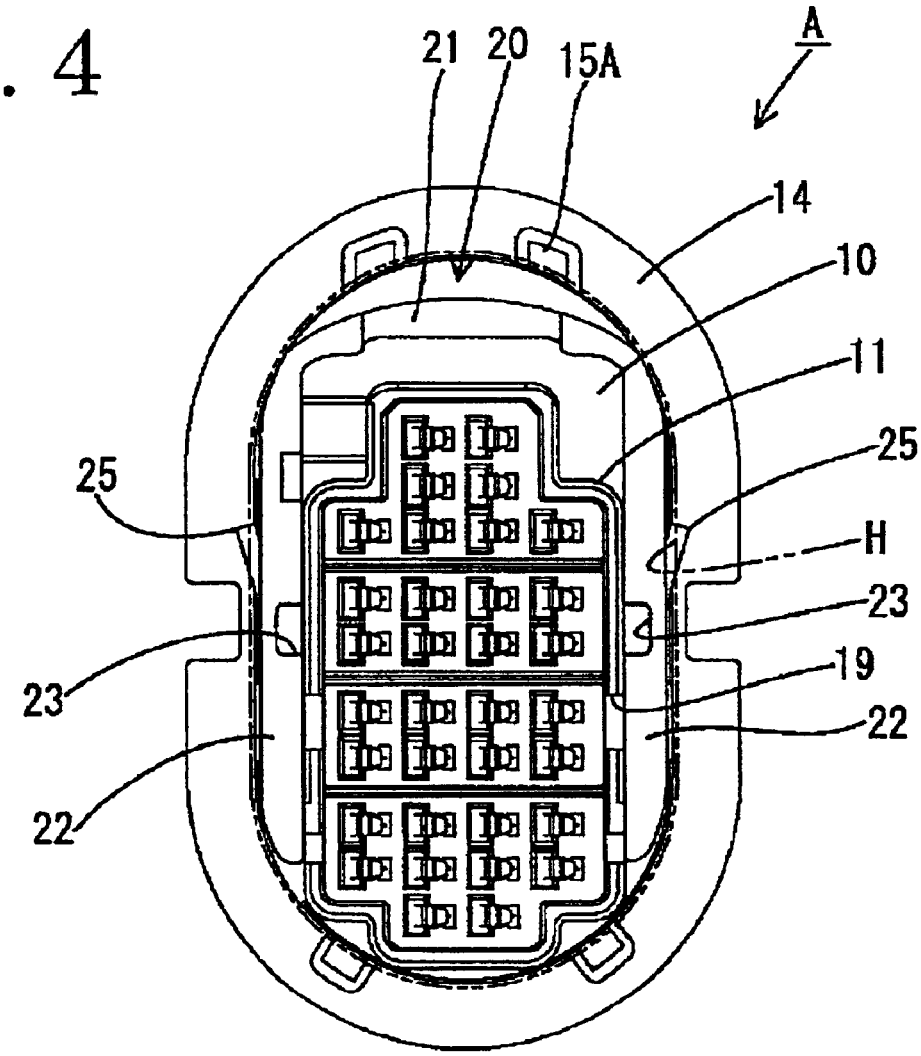
FIG. 4 is a front view showing the partly connected state of the two housings.
Figure 5:
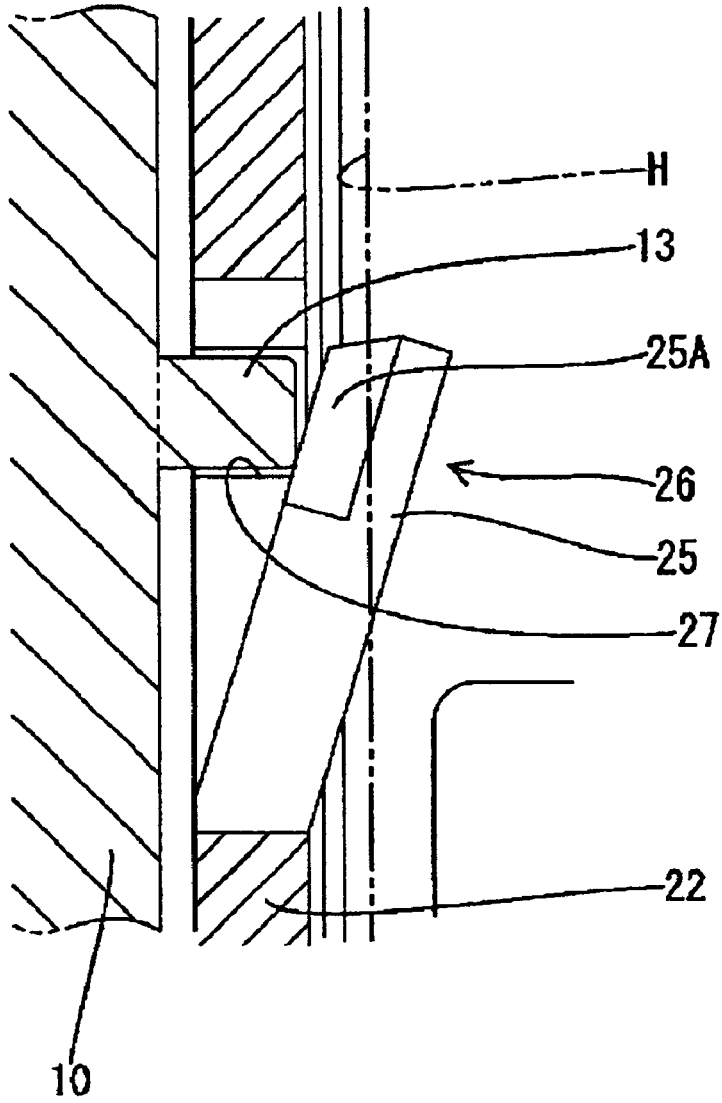
FIG. 5 is an enlarged fragmentary section showing a state where a movable detector is resiliently displaced to an interfering position.
Figure 6:
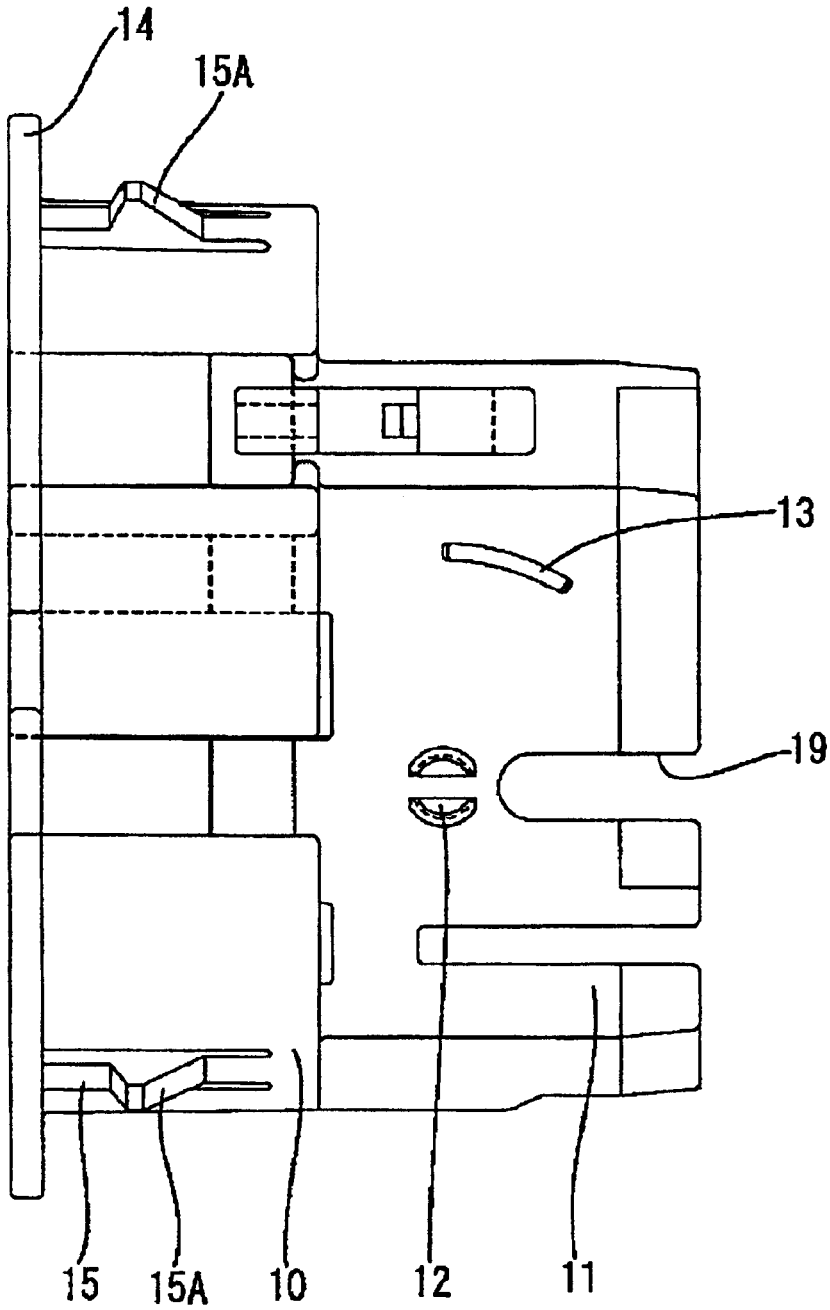
FIG. 6 is a side view of the male housing with a lever detached.
Figure 7:
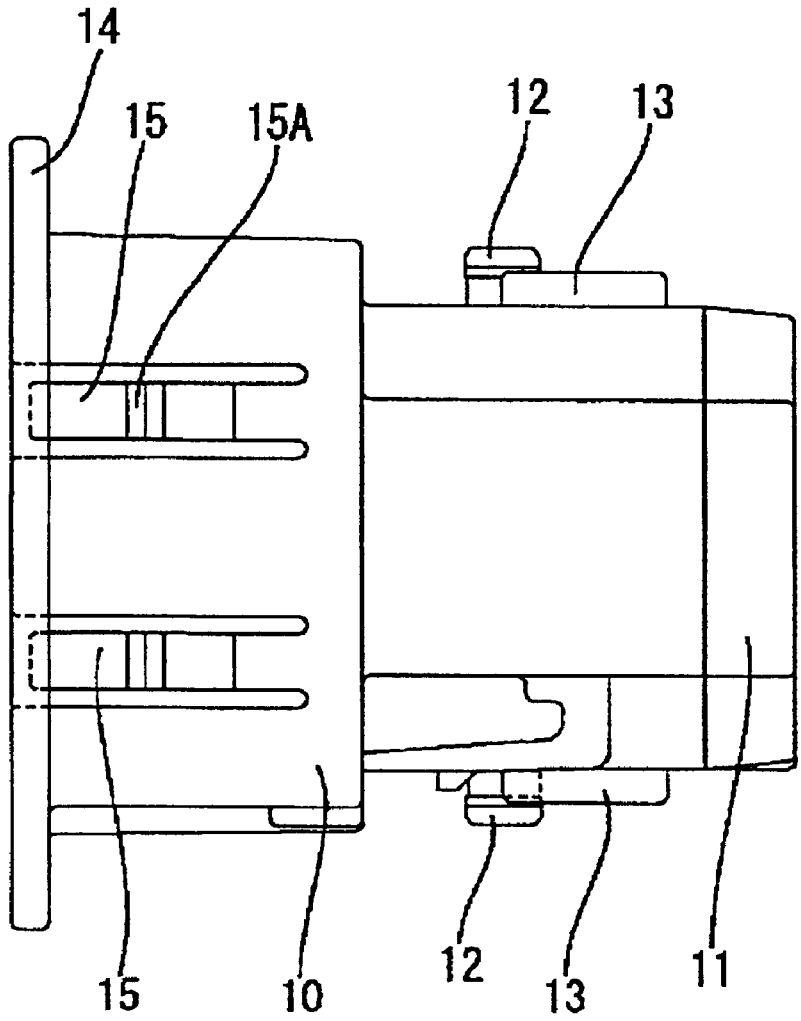
FIG. 7 is a plan view of the male housing with the lever detached.
Figure 8:
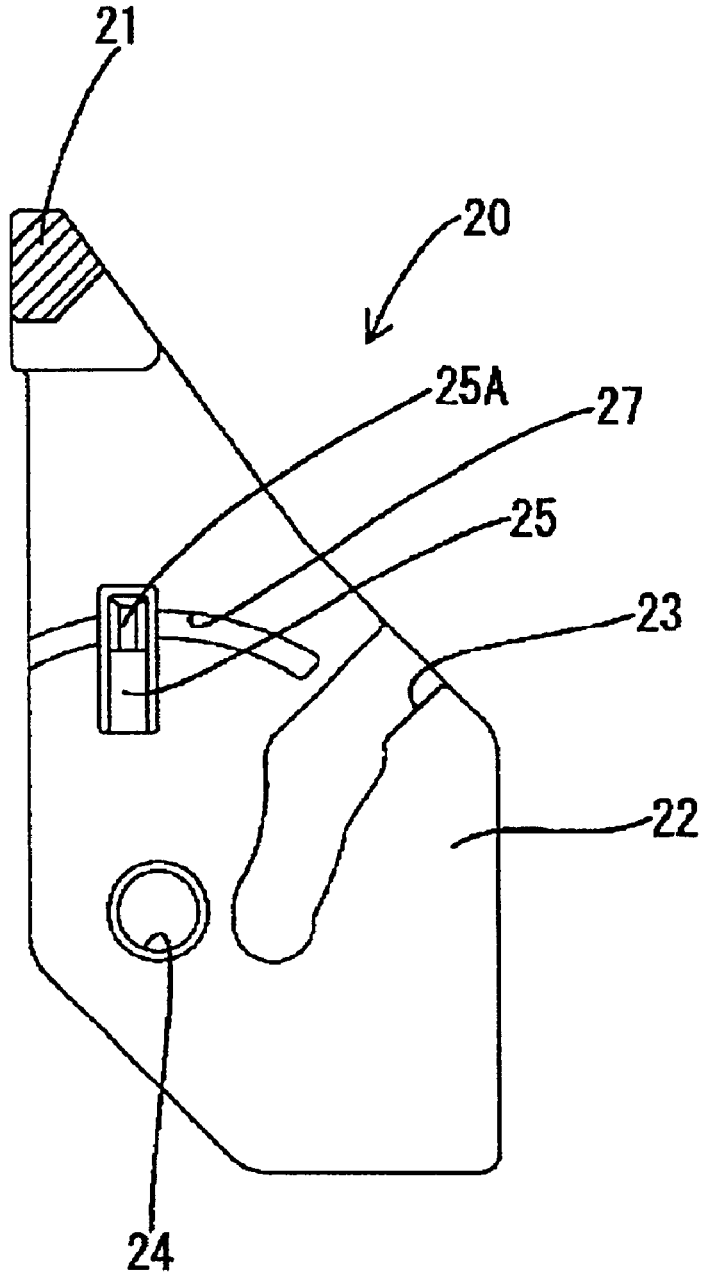
FIG. 8 is a section of the lever.
Figure 9:
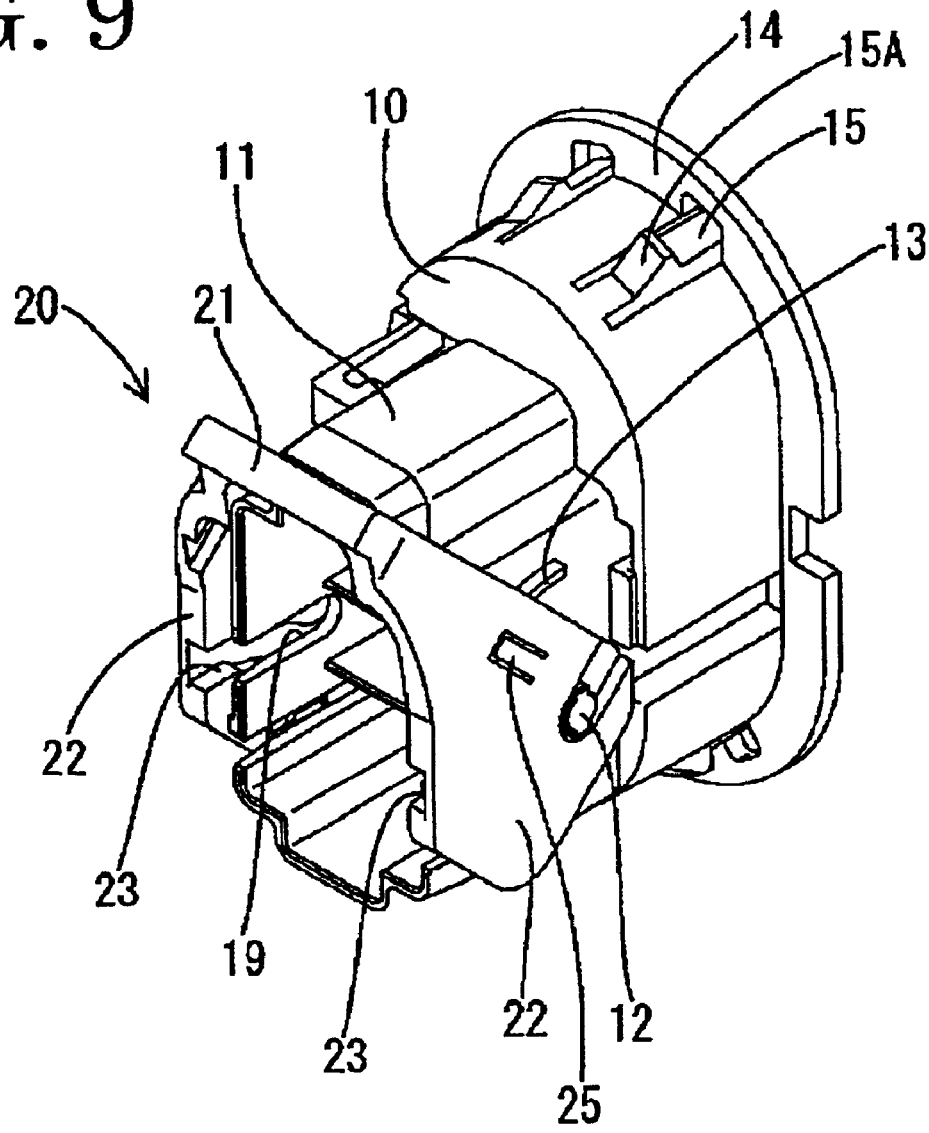
FIG. 9 is a perspective view of the male connector housing.

A movable detector 25 is formed in each arm 22 and cantilevers radially out from the bearing hole 24. The movable detectors 25 and the pushers 13 form a connection detecting means 26, and are normally at standby positions where the outer surfaces of the movable detectors 25 are substantially flush with the outer surfaces of the arms 22. However, the movable detectors 25 are resiliently displaceable to interfering positions (FIG. 5) where they project out beyond the outer surfaces of the arms 22. The free ends of the movable detectors 25 face up and in a direction substantially normal to a mounting direction of the connector A into the mount hole H when the lever 20 is at a partial connection position shown in FIG. 3, i.e. a position between a standby position where cam followers 31 are permitted to enter the cam grooves 23 and a proper connection position (see FIG. 1). A substantially trapezoidal pushable portion 25A is formed on the inner surface of the free end of each movable detector 25 and has slanted surfaces at opposite ends with respect to a rotating or pivotal direction. When the lever 20 is at the partial connection position, the pushable portions 25A of the movable detectors 25 contact the pushers 13 and are pushed resiliently to the interfering positions, as shown in FIG. 5. Substantially arcuate escape grooves 27 are formed in the inner surfaces of the lever 20 to prevent the lever 20 from interfering with the pushers 13 during substantially the entire pivotal movement of the lever 20 between the standby position and the proper connection position. Each pusher 13 is at intermediate positions of the corresponding escape groove 27 along the pivoting path of the movable detecting portion 25.

The female housing 30 is fittable into the receptacle 11 and has two cam followers 31 that project from the left and right outer side surfaces. Upon fitting the female housing 30 into the receptacle 11, the cam followers 31 project to the outer side of the receptacle 11 through slits 19 in the receptacle 11, and hence are engageable with the cam grooves 23.

The housings 10, 30 are connected by first holding the lever 20 of the male housing 10 at the standby position (not shown) at the front side (left side in FIG. 1) of the panel P. The female housing 30 then is introduced into the mounting hole H from the back side of the panel P and is fit lightly into the receptacle 11 at the front side of the panel P so that the cam followers 31 enter the cam grooves 23. The lever 20 then is pivoted in the counterclockwise direction of FIGS. 1 and 3, and the housings 10, 30 move smoothly into proper connection with each other due to the leverage action of the engagement of the cam followers 31 and the cam grooves 23 even if the operation force applied to the lever 20 is small. At an intermediate stage of the connection of the two housings 10, 30, the movable detectors 25 contact the pushers 13 and are displaced resiliently to the interfering positions at the outer side. When the two housings 10, 30 are connected properly, the movable detectors 25 pass the pushers 13 and resiliently return toward the standby positions where they are substantially flush with the outer surfaces of the arms 22.

The properly connected connector A can be fit into the mount hole H from the front of the panel P with the receptacle 11 facing the mount hole H. At this time, the movable detectors 25 are at the standby positions where they are substantially flush with the outer surfaces of the arms 22 and do not interfere with the edge of the mount hole H. Accordingly, the connector A can be fitted into the mount hole H sufficiently to bring the flange 14 into contact with the front surface of the panel P and engaging projections 15A of the resilient locks 15 engage with the rear surface of the panel P as shown in FIG. 1.

If an attempt is made to fit the connector A into the mount hole H with the housings 10, 30 incompletely connected, the movable detectors 25 move onto the pushers 13 and are displaced resiliently to the interfering positions where they project out beyond the outer surfaces of the arms 22 as shown in FIG. 5. The projecting movable detectors 25 catch and interfere with the edge of the mount hole H. Thus, the connector A cannot be fitted into the mount hole H any further, thereby detecting partial connection of the housings 10, 30.

As described above, the movable detectors 25 are at the standby positions when the housings 10, 30 are connected properly with each other. The housings 10, 30 then can be mounted into the mount hole H. However, the movable detectors 25 are displaced to the interfering positions when the housings 10, 30 are only partly connected, and hence the movable projections interfere with the edge of the mount hole H. Therefore, whether the housings 10, 30 are connected properly can be detected based on whether the movable detectors 25 interfere with the edge of the mount hole H and whether the connector A can be mounted into the mount hole H.

Further, the two housings 10, 30 are connectable with a small operation force due to the leverage action of the lever 20. Therefore, a connecting operation can be completed with one hand and the connector A can be used in a narrow space.

The pushers 13 project from the outer surfaces of the male housing 10, and the escape grooves 27 for avoiding the interference with the pushers 13 are formed in the inner surfaces of the lever 20. Thus, the connector A can be made smaller by making clearances between the outer surfaces of the male housing 10 and the inner surfaces of the lever 20.

The present invention is not limited to the above described and illustrated embodiment. For example, the following embodiment is also embraced by the technical scope of the present invention as defined by the claims. Beside the following embodiment, various changes can be made without departing from the scope and spirit of the present invention as defined by the claims.

The invention is applied to a lever-type connector in the foregoing embodiment. However, it is also applicable to connectors with no a lever. In such a case, a movable detecting portion is formed on the surrounding wall of the receptacle of the male housing and a pusher in the form of a projection is formed on the outer surface of the female connector housing. Thus, the pusher pushes the movable detector from inside with the two partly connected housings to displace the movable detectors to the interfering position.

Even though the invention has been described with a reference to a pivoting lever on one of the housings, the lever may be movable along a linear or other non-linear path such as a slider.

What is claimed is:

1. A connector fittable into a mount hole of a panel, the connector comprising first and second housings connected with each other, a lever pivotally mounted on the first housing, the lever being formed with a cam groove, a cam follower being provided on the second housing and being engaged with the cam groove, connection of the housings being assisted by moving the lever while the cam follower is engaged with the cam groove, the housings comprise at least one movable detector located at a standby position where the movable detector does not interfere with an edge of the mount hole when the housings are connected properly so that the connected housings can be inserted through the mount hole and mounted on the panel, the movable detector being displaced to an interfering position where the movable detector interferes with the edge of the mount hole when the two housings are connected partly so that the partly connected housings cannot fit through the mount hole to provide an indication of partial connection prior to mounting the connected housings on the panel.

2. The connector of claim 1, wherein the movable detector is formed on the lever to be normally at the standby position and being resiliently displaceable to the interfering position.

3. The connector of claim 2, wherein the lever is substantially U-shaped and has lateral arms, a transverse spacing between outer surfaces of the lateral arms being slightly smaller than a width of the mount hole.

4. The connector of claim 2, wherein a pusher is formed or/an outer surface of the first housing for pushing the movable detector from inside to resiliently displace the movable detector to the interfering position only when the lever is at a partial connection position.

5. The connector of claim 1, wherein the movable detector is resiliently displaceable from the standby position to the interfering position and is biased toward the standby position.

6. A connector fittable into a mount hole of a panel, the connector comprising first and second housings connected with each other, a lever pivotally mounted on the first housing and being formed with a cam groove, a cam follower being provided on the second housing and being engaged with the cam groove, connection of the housings being assisted by moving the lever while the cam follower is engaged with the cam groove, a movable detector formed on the lever and being in the standby position when the lever is moved to a position for properly connecting the first and second housings, the movable detector being configured to avoid interference with an edge of the mount hole when the movable detector is in the standby position, a pusher which projects from an outer surface of the first housing and has a substantially arcuate shape extending along a trace of rotation of the movable detector, the pusher being configured for pushing the movable detector into an interfering position when the lever is at a partial connection position corresponding to incomplete connection of the first and second housings, the movable detector being configured to interfere with an edge of the mount hole when the housings are connected partly.

7. The connector of claim 6, wherein a substantially arcuate escape groove is formed in the inner surface of the lever for avoiding an interference with the pusher.

8. The connector according of claim 7, wherein the movable detector is formed with at least one slanted pushable portion for contacting the pusher.

9. A connector fittable into a mount hole of a panel, the mount hole defining a selected cross section, the connector comprising first and second housings connectable with each other, the housings comprising at least one movable detector located at a standby position when the housings are connected properly, the movable detector being displaced to an interfering position when the two housings are connected partially, such that a cross section of the connector taken through the movable detector is smaller than the cross section of the mount hole when the movable detector is at the standby position so that the housings are insertable through the mount hole of the panel when the housings are connected properly, and such that a cross section of the connector taken through the movable detector is larger than the cross section of the mount hole in at least one direction when the movable detector is at the interfering position so that the housings cannot pass through the mount hole of the panel when the housings are connected partial .

10. The connector of claim 9, further comprising a lever pivotally mounted on the first housing, the lever being formed with a cam groove, a cam follower being provided on the second housing and being engaged with the cam groove, connection of the housings being assisted by moving the lever while the cam follower is engaged with the cam groove.

11. The connector of claim 10, wherein the movable detector is formed on the lever to be normally at the standby position and being resiliently displaceable to the interfering position.

12. The connector of claim 11, wherein a pusher is formed on the first housing for pushing the movable detector from inside to resiliently displace the movable detector to the interfering position only when the lever is at a partial connection position.

13. A connector fittable into a mount hole of a panel, the mount hole defining a selected cross section, the connector comprising first and second housings connectable with each other, a lever pivotally mounted on the first housing, the lever being formed with a cam groove, a cam follower being provided on the second housing and being engaged with the cam groove, connection of the housings being assisted by moving the lever while the cam follower is engaged with the cam groove, at least one movable detector formed on the lever, the movable detector being at a standby position when the housings are connected properly, a pusher formed on the first housing for pushing the movable detector from inside to resiliently displace the movable detector to an interfering position only when the lever is at partial connection position, wherein the pusher projects from the outer surface of the first housing and has a substantially arcuate shape extending along a trace of rotation of the movable detector, a cross section of the connector taken through the movable detector being smaller than the cross section of the mount hole when the movable detector is at the standby position so that the housings are insertable through the mount hole of the panel when the housings are connected properly, and such that a cross section of the connector taken through the movable detector is larger than the cross section of the mount hole in at least one direction when the movable detector is at the interference position so that the housings cannot pass through the mount hole of the panel when the housings are connected partially.

14. The connector of claim 13, wherein a substantially arcuate escape groove is formed in the inner surface of the lever for avoiding an interference with the pusher.

15. The connector according of claim 14, wherein the movable detector is formed with at least one slanted pushable portion for contacting the pusher.

16. A connector comprising first and second housings connectable with each other, a cam follower being formed on the second housing, a lever movably mounted on the first housing and being formed with a cam groove configured and disposed to engage the cam follower, such that movement of the lever causes the cam groove and the cam follower to move the housings into connection with one another, at least one movable detector formed on the lever and having an unbiased position where the movable detector is substantially flush with portions of the lever adjacent the movable detector, a pusher formed on portions of the first housing adjacent the lever, the pusher being dimensioned and disposed to deflect the movable detector resiliently from adjacent portions of the lever when the lever is moved from the standby position, the pusher being disposed to push the movable detector away from adjacent portions of the lever when the first and second housings are only partly connected with one another, and being configured for permitting the movable detector to move into the unbiased position substantially flush with portions of the lever adjacent the movable detector when the first and second housings are connected properly, such that the movable detector defines a larger cross section when the housings are connected only partly.

17. The connector of claim 16, wherein the lever is substantially U-shaped and has lateral arms pivotally mounted on the first housing, the at least one movable detector comprising two movable detectors mounted respectively on the arms of the lever.

18. The connector of claim 17, wherein the pusher comprises two pushers that project from the outer surface of the first housing and has a substantially arcuate shape extending along a trace of rotation of the movable detector.

19. The connector of claim 18, wherein substantially arcuate escape grooves are formed on surfaces of the arms of the lever that face the first housing for avoiding interference with the pusher.

* * * * *